US009957106B2

(12) United States Patent
Pedersen et al.

(10) Patent No.: US 9,957,106 B2
(45) Date of Patent: May 1, 2018

(54) METHODS AND SYSTEMS FOR WASTE MANAGEMENT

(71) Applicant: THE BOEING COMPANY, Chicago, IL (US)

(72) Inventors: Aaron John Pedersen, Summerville, SC (US); Joseph E. Magera, Summerville, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days. days.

(21) Appl. No.: 15/012,055

(22) Filed: Feb. 1, 2016

(65) Prior Publication Data

US 2016/0340118 A1 Nov. 24, 2016

Related U.S. Application Data

(63) Continuation-in-part of application No. 14/718,787, filed on May 21, 2015.

(51) Int. Cl.

| | |
|---|---|
| ***B65D 43/22*** | (2006.01) |
| ***B65F 1/16*** | (2006.01) |
| ***B65F 1/00*** | (2006.01) |

(52) U.S. Cl.

CPC ..... *B65F 1/1623* (2013.01); *B65F 1/0093* (2013.01); *B65F 1/1607* (2013.01); *B65F 2210/1125* (2013.01)

(58) Field of Classification Search

CPC ..... B65F 1/1431; B65F 1/1646; B65F 1/1623
USPC ..... 220/828, 810, 908, 908.1–908.3, 910, 220/911, 256.1, 259.1
See application file for complete search history.

(56) References Cited

U.S. PATENT DOCUMENTS

| | | | | |
|---|---|---|---|---|
| 203,817 | A * | 5/1878 | Brock | B65F 1/1623 220/828 |
| 955,908 | A * | 4/1910 | Ross | B65D 47/0847 119/867 |
| 3,850,336 | A * | 11/1974 | Acosta | B65F 1/1623 220/830 |
| 4,032,037 | A * | 6/1977 | Dubery | B65F 1/1607 220/825 |
| 4,108,498 | A | 8/1978 | Bentsen | |
| 4,993,882 | A | 2/1991 | Nishizuka et al. | |
| 5,083,704 | A | 1/1992 | Rounthwaite | |
| 5,221,010 | A | 6/1993 | Bianco | |
| 5,253,766 | A | 10/1993 | Sims | |
| 5,316,152 | A | 5/1994 | Ross | |
| 5,492,227 | A | 2/1996 | Millette et al. | |

(Continued)

FOREIGN PATENT DOCUMENTS

| | | | |
|---|---|---|---|
| WO | 1993020006 | A1 | 10/1993 |
| WO | 2006123123 | A1 | 11/2006 |

(Continued)

*Primary Examiner* — Kareen Thomas
(74) *Attorney, Agent, or Firm* — Armstrong Teasdale LLP

(57) ABSTRACT

A lid assembly for use with a waste management system includes a lid having an opening defined therethrough, wherein the lid assembly is configured to couple to a container. The lid assembly also includes at least one flap assembly including a counterbalance mechanism pivotally coupled to the lid and a flap portion coupled to the counterbalance mechanism. The flap assembly is moveable between a closed position and an open position to selectively obstruct the opening.

19 Claims, 10 Drawing Sheets

(56) References Cited

U.S. PATENT DOCUMENTS

| | | | | |
|---|---|---|---|---|
| 5,667,136 | A | 9/1997 | Chen | |
| 5,695,115 | A | 12/1997 | Shantzis et al. | |
| 5,772,112 | A | 6/1998 | Bulcroft | |
| 5,806,759 | A | 9/1998 | Axisa | |
| 6,024,238 | A * | 2/2000 | Jaros | B65F 1/163 16/84 |
| 6,810,819 | B2 | 11/2004 | Kaniuk et al. | |
| 7,070,064 | B1 * | 7/2006 | Henry | B65F 1/1623 220/262 |
| 7,690,493 | B1 | 4/2010 | Nunis | |
| 7,958,704 | B2 | 6/2011 | Stravitz et al. | |
| 8,523,051 | B2 | 9/2013 | Clancy et al. | |
| 8,771,606 | B2 | 7/2014 | Sun | |
| 2003/0136279 | A1 * | 7/2003 | Tarlow | B30B 9/305 100/90 |
| 2009/0126473 | A1 | 5/2009 | Porat et al. | |
| 2009/0156071 | A1 * | 6/2009 | Davis | B63B 19/00 440/89 R |
| 2009/0314665 | A1 | 12/2009 | Konstantinos | |
| 2012/0321395 | A1 | 12/2012 | Piazza | |
| 2016/0215546 | A1 * | 7/2016 | Decker | E05D 11/087 |

FOREIGN PATENT DOCUMENTS

| | | | |
|---|---|---|---|
| WO | 2013072655 | A1 | 5/2013 |
| WO | 2014029903 | A1 | 2/2014 |
| WO | 2014114849 | A1 | 7/2014 |
| WO | 2015015053 | A1 | 2/2015 |
| WO | 2015015054 | A1 | 2/2015 |
| WO | 2015015055 | A1 | 2/2015 |

* cited by examiner

METHODS AND SYSTEMS FOR WASTE MANAGEMENT

CROSS-REFERENCE TO RELATED APPLICATIONS

This application is a continuation-in-part and claims priority to, U.S. patent application Ser. No. 14/718,787 filed on May 21, 2015, and subsequently issued as U.S. Pat. No. 9,738,442 issued on Aug. 22, 2017, for "METHODS AND SYSTEMS FOR WASTE MANAGEMENT", which is hereby incorporated by reference in its entirety.

BACKGROUND

The field of the disclosure relates generally to waste management systems, and more specifically, to transferring waste from an elevated platform to ground level.

At least some known manufacturing facilities include elevated platforms that provide technicians access to a specified work site on a product, such as an aircraft. As the technicians perform their duties, an amount of waste is generated that requires sorting into various categories. For example, when working on an aircraft, waste is generally sorted into three different types: flammable waste, corrosive waste, and general foreign object debris (FOD) waste. At least some known facilities store a separate waste container for each waste type on the platform. Each waste container also includes a lid to contain not only the waste, but also any potentially harmful vapors from escaping the waste container.

A waste collection team is responsible for emptying the waste containers, often multiple times per day, on each platform. At least some known manufacturing facilities require the waste collection team to ascend a set of platform stairs to retrieve a waste container and descend the stairs, while carrying the heavy waste container, to empty the waste container at ground level. The waste collection team then ascends the stairs to replace the first waste container and retrieve a second waste container. As a result, members of the waste collection team may ascend and descend stairs between 75-100 times per day. Furthermore, the waste collection team is often carrying a waste container each time they ascend and descend the stairs, which may lead to a loss of balance or other safety concerns.

One solution is to provide a chute at the platform that deposits waste into an associated container. The waste travels down the chute from the platform and impinges a pair of hinged flaps that open upon impact to allow the waste to fall into the container. The hinged flaps include a spring mechanism that returns the flaps to a position that covers an opening in the chute to reduce an amount of waste vapor from traveling up the chute. The mechanical springs may have decreased performance over time, causing the spring to be replaced periodically to maintain the performance desired to prevent vapors from escaping back up the chute.

BRIEF DESCRIPTION

In one aspect, a lid assembly for use with a waste management system is provided. The lid assembly includes a lid having an opening defined therethrough, wherein the lid assembly is configured to couple to a container. The lid assembly also includes at least one flap assembly including a counterbalance mechanism pivotally coupled to the lid and a flap portion coupled to the counterbalance mechanism. The flap assembly is moveable between a closed position and an open position to selectively obstruct the opening.

In another aspect, a waste management system is provided. The waste management system includes a chute configured to channel waste therethrough, a container configured to collect the waste channeled through the chute, and a lid assembly coupled between the chute and the container. The lid assembly includes a lid coupled to the container and having an opening defined therethrough. The lid assembly also includes at least one flap assembly including a counterbalance mechanism pivotally coupled to the lid and a flap portion coupled to the counterbalance mechanism. The flap assembly is moveable between a closed position and an open position to selectively obstruct the opening.

In yet another aspect, a method of assembling a lid assembly for use with a waste management system is provided. The method includes defining an opening in a lid and pivotally coupling a body of at least one counterbalance mechanism to the lid proximate the opening. The method also includes coupling at least one flap portion to a first end of the body and coupling a counterbalance weight to an opposing second end of the body. The at least one counterbalance mechanism and at least one flap portion are moveable between a closed position and an open position to selectively obstruct the opening.

The features, functions, and advantages that have been discussed can be achieved independently in various embodiments or may be combined in yet other embodiments, further details of which can be seen with reference to the following description and drawings.

DETAILED DESCRIPTION

The embodiments described herein facilitate depositing various types of waste into a respective chute on a platform and collecting the waste in containers located at ground level. A technician determines whether they have FOD (foreign object debris) waste, corrosive waste, or flammable waste and deposits the waste into an appropriate chute at a waste disposal station located on the platform.

Furthermore, the embodiments described herein illustrate a lid assembly that uses a counterbalance weight to automatically return a flap assembly to a closed position once waste has passed therethrough. The lid assembly includes a lid coupled to a container and defining an opening therethrough. A flap assembly is coupled to opposing sides of the opening and includes a counterbalance mechanism pivotally coupled to the lid and a flap portion coupled to the counterbalance mechanism that at least partially covers the lid opening. As described above, when waste impinges on the flap portions, the flap assembly moves from the closed position to the open position to enable the waste to fall into the container. An adjustable counterbalance weight on the counterbalance mechanism then causes the flap assembly to pivot and return to the closed position. In the closed position, the flap portions form a seal with a sealing strip on the underside of the lid to prevent the escape of vapors or airborne waste form the container.

The use of a counterbalance weight to return the flap assembly to the closed position takes advantage of gravity to move the flap assembly instead of using a positive biasing mechanism, such as a mechanism spring, that may have decreased performance over time. As such, the lid assembly described herein is a cost and labor efficient system to maintain the performance desired to prevent vapors from escaping the container and traveling back up the chute.

Figure 1:
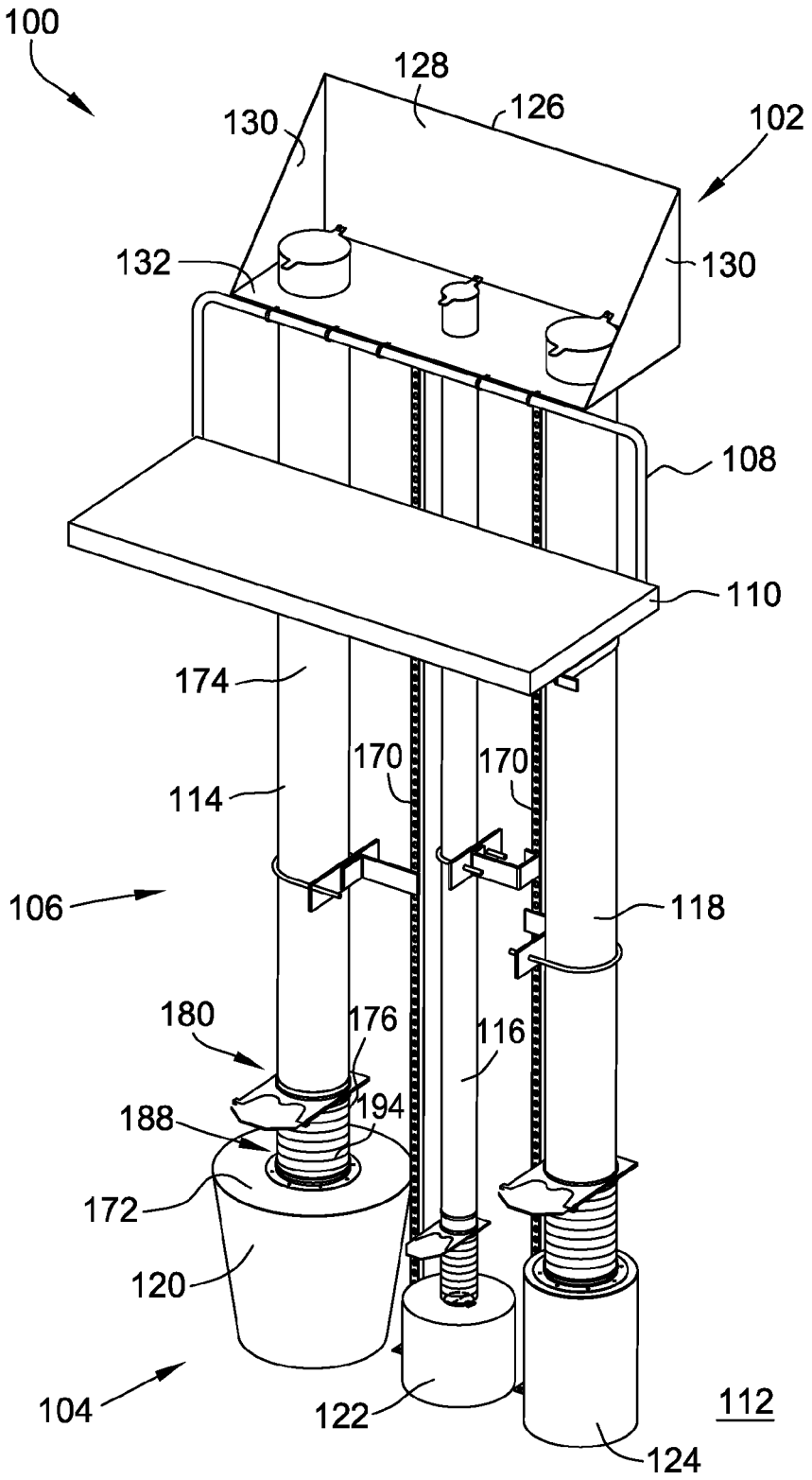
FIG. 1 is a perspective view of an exemplary waste management system including a plurality of chutes and containers.

FIG. 1 is a perspective view of an exemplary waste management system 100. In the exemplary implementation, system 100 includes a waste disposal station 102, a plurality of waste containers 104, and a plurality of chutes 106 coupled between station 102 and a respective container 104. System 100 is used to transfer waste from waste disposal station 102 and through plurality of chutes 106 for disposal in plurality of containers 104. In the exemplary implementation, waste disposal station 102 is coupled to a railing 108 of an elevated platform 110, and containers are located at ground level 112 such that the waste generated by technicians working on platform 110 is channeled through chutes 106 to ground level 112.

In the exemplary implementation, plurality of chutes 106 includes a first chute 114, a second chute 116, and a third chute 118. Similarly, plurality of containers 104 includes a first container 120 coupled to first chute 114, a second container 122 coupled to second chute 116, and a third container 124 coupled to third chute 118. First chute 114 channels general foreign object debris (FOD) waste between waste disposal station 102 at platform 110 and first container 120, while second chute 116 channels flammable waste, and third chute 118 channels corrosive waste. According to federal Occupational Safety and Health Administration (OSHA) regulations, different types of waste must be separated and clearly identified by color. More specifically, second container 122 is colored red to indicate flammable materials contained therein, while third container 124 is colored yellow to indicate corrosive materials contained therein. Although waste management system 100 illustrates three separate chutes and containers in FIG. 1, in other implementations, waste management system 100 may include only a single chute and associated container. Generally, waste management system 100 may include any number of chutes and associated containers as desired.

Figure 2:
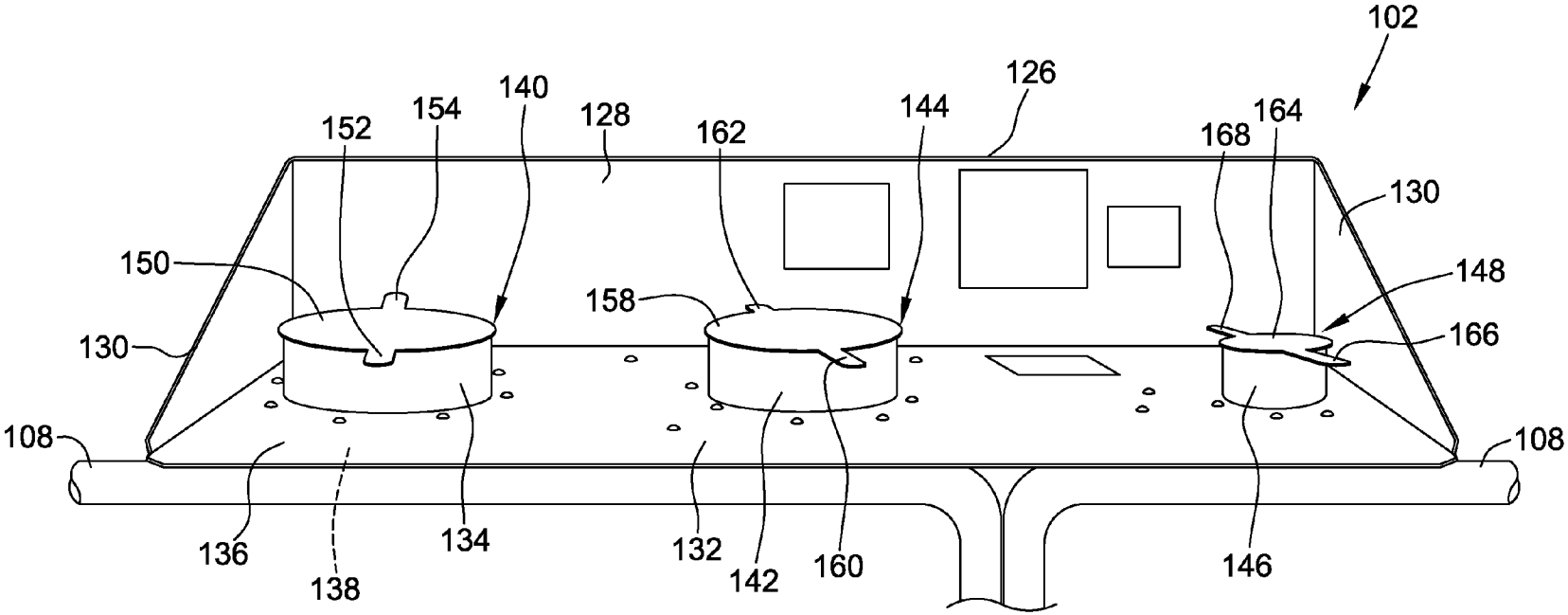
FIG. 2 is a perspective view of an exemplary waste disposal station that may be used with the waste management system shown in FIG. 1.
Figure 3:
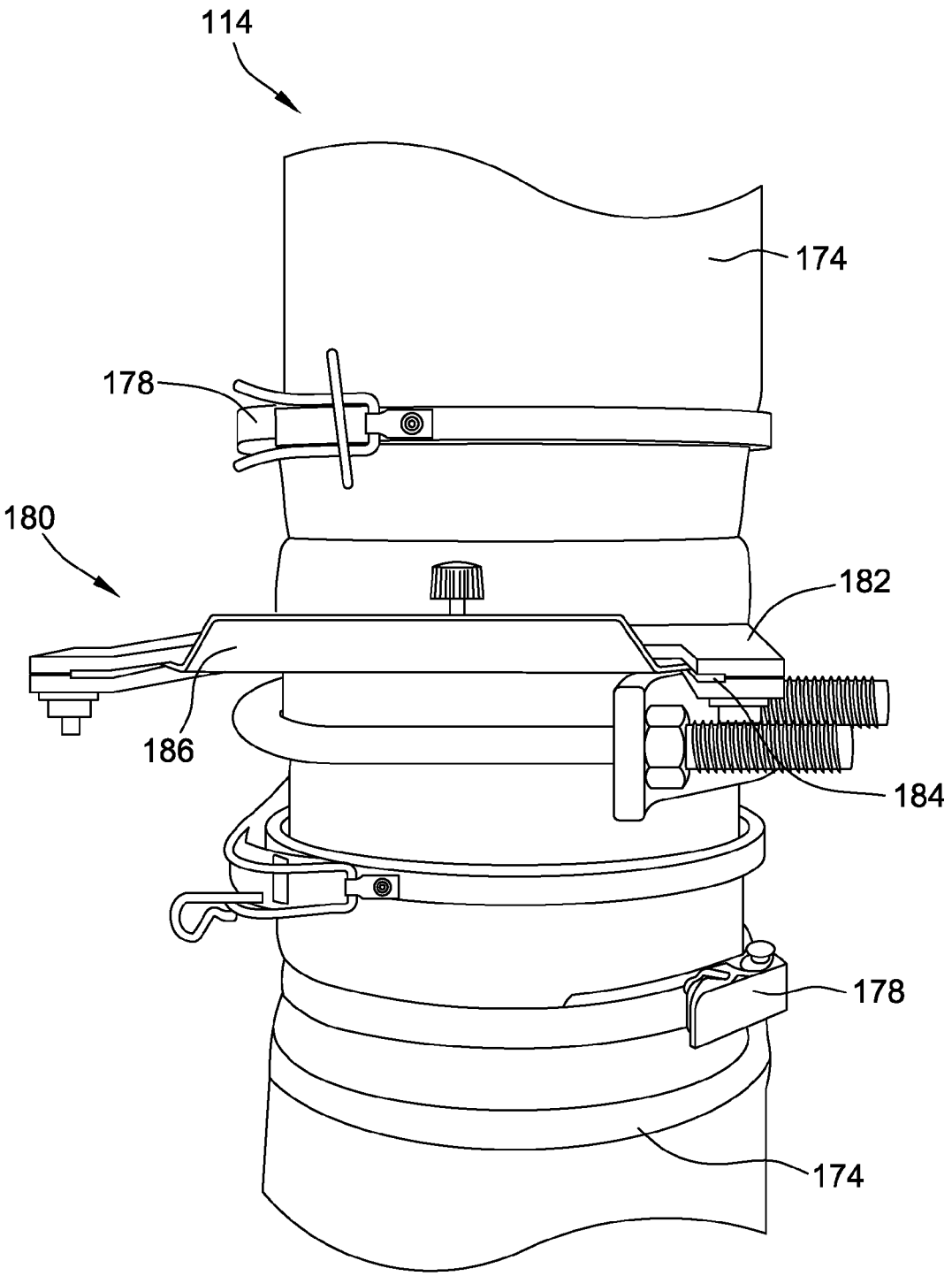
FIG. 3 is a side view of an exemplary chute gate assembly that may be used with the waste management system shown in FIG. 1.

FIG. 2 is a perspective view of waste disposal station 102 that may be used with waste management system 100 (shown in FIG. 1), and FIG. 3 is a side view of a portion of waste disposal station 102. In the exemplary implementation, waste disposal station 102 is coupled to railing 108 such that station 102 overhangs railing 108. As such, a technician working on platform 110 (shown in FIG. 1) is able to utilize substantially an entire area of platform 110 without any portion of waste management system 100 interfering. Waste disposal station 102 includes a housing 126 that includes a rear wall 128, a pair of sidewalls 130, and a bottom wall 132. Walls 128, 130, and 132 of housing 126 are configured to reduce a risk of waste falling from platform 110 to ground level 112 below. In the exemplary implementation, housing 126 is formed from a lightweight, non-corrosive material, such as, but not limited to, aluminum. Alternatively, housing 126 is formed from any material that enables operation of waste disposal station 102 as described herein.

In one implementation, first chute 114 includes a top end 134 that extends upwards through bottom wall 132 of housing 126. As such, both a top surface 136 and a bottom surface 138 of bottom wall 132 are coupled to top end 134 to provide structural integrity to first chute 114. Furthermore, top end 134 also defines an opening 140 into which the technicians may deposit the waste. Similarly, second chute 116 includes a top end 142 that extends through bottom wall 132 and defines an opening 144 and third chute 118 includes a top end 146 that extends through bottom wall 132 and defines an opening 148. Alternatively, chutes 114, 116, and 118 are coupled to housing 126 in any manner that enable operation of waste disposal station 102 as described herein.

Additionally, top end 134 of first chute 114 includes a lid 150 that is selectively movable by a technician between a first position (closed) and a second position (open). Lid 150 includes a handle 152 and a stopper mechanism 154. Handle 152 is engaged manually by a technician to lift lid 150 from the closed position to the open position to allow the technician to deposit waste into first chute 114. As the technician lifts handle 152, lid 150 pivots about a hinge axis (not shown) until stopper mechanism 154 contacts top end 134. In the exemplary implementation, stopper mechanism 154 contacts top end 134 before lid 150 has pivoted 90 degrees. As such, stopper mechanism 154 prevents lid 150 from being opened past a predetermined point such that lid 150 cannot remain in the opened second position when not being manually held open by a technician. Alternatively, stopper mechanism 154 may extend from the outer surface of top end 134 and contact lid 150 when the technician lifts lid 150 to a predetermined position.

In operation, lid 150 covers opening 140 and prevents any vapors or airborne particles from rising through first chute 114 and escaping through opening 140 at top end 134. Similarly, second chute 116 includes a lid 158 that includes a handle 160 and a stopper 162, and third chute 118 includes a lid 164 that includes a handle 166 and a stopper 168. In the exemplary implementation, lids 150, 158, and 164 are each colored a different color to indicate which type of waste is meant to be deposited therein. For example, lid 150 on first chute 114 is colored grey to indicate general FOD waste, lid 158 on second chute 116 is colored red to indicated flammable waste, and lid 164 on third chute 118 is colored yellow to indicate corrosive waste. As such, lids 150, 158 and 164 are colored in accordance with OSHA regulations to indicate a specific type of waste to be deposited therein.

Referring again to FIG. 1, waste management system 100 includes at least one support beam 170 that supports the weight of waste disposal station 102. In the exemplary implementation, supports beams 170 are substantially parallel to each chute 106 and extend between bottom wall 132 of housing 126 and ground level 112. In another suitable implementation, such as when platform 110 and railing 108 are moveable, support beams 170 extend between bottom wall 132 and at least one of railing 108 and platform 110 to allow for mobility of platform 110.

Except as specifically described otherwise, chutes 114, 116, and 118 of plurality of chutes 106 are substantially similar to each other. As such, only first chute 114 is described herein in detail. However, second and third chutes 116 and 118 include similar features and components. First chute 114 extends between waste disposal station housing 126 and a lid 172 of first container 120. In the exemplary implementation, first chute 114 includes a rigid portion 174 and a biasing portion 176. Rigid portion 174 is coupled to housing bottom wall 132 and includes top end 134. Biasing portion 176 is coupled to lid 172. In the exemplary implementation, rigid portion 174 may be formed from at least two rigid sections. In such a configuration, the rigid sections are coupled together using a clamp 178 (shown in FIG. 3) such that no portion of a fastener extends through rigid portion 174 and into the channel through which the waste travels. Alternatively, adjacent rigid sections of rigid portion 174 are coupled together in any manner to enable operation of waste management system 100 as described herein. Furthermore, rigid portion 174 is formed from a metallic material, such as, but not limited to, aluminum, such that rigid portion 174 is a relatively lightweight, non-corrosive material. Biasing portion 176 is formed from a translucent or transparent, fire-resistant material that enables a technician to observe when container 120 is full or if biasing portion 176 is clogged with waste. Alternatively, portions 174 and 176 are formed from any material that facilitates operation of chute 114 as described herein.

FIG. 3 is a side view of an exemplary chute gate assembly 180 that may be used with waste management system 100. In one implementation, gate assembly 180 is coupled between adjacent rigid portions 174 and biasing portion 176 of chute 114, as shown in FIG. 3. In another implementation, gate assembly 180 is coupled between rigid portion 174 and biasing portion 176, as shown in FIG. 1. Gate assembly 180 includes a housing 182 coupled between adjacent portions of chute 114. Housing 182 defines a slot 184 that is configured to receive a gate 186 therein. Gate 186 is configured to selectively slide into and out of slot 184 to selectively block chute 114 when a technician is in the process of emptying container 120. As such, technicians working on platform 110 may continue to use waste disposal station 102 to deposit waste even during emptying of containers 104 at ground level 112. When container 120 is emptied and replaced, the technician slides gate 186 partially out of slot 184 to allow any waste deposited during emptying of container 120 to fall into container 120.

Figure 4:
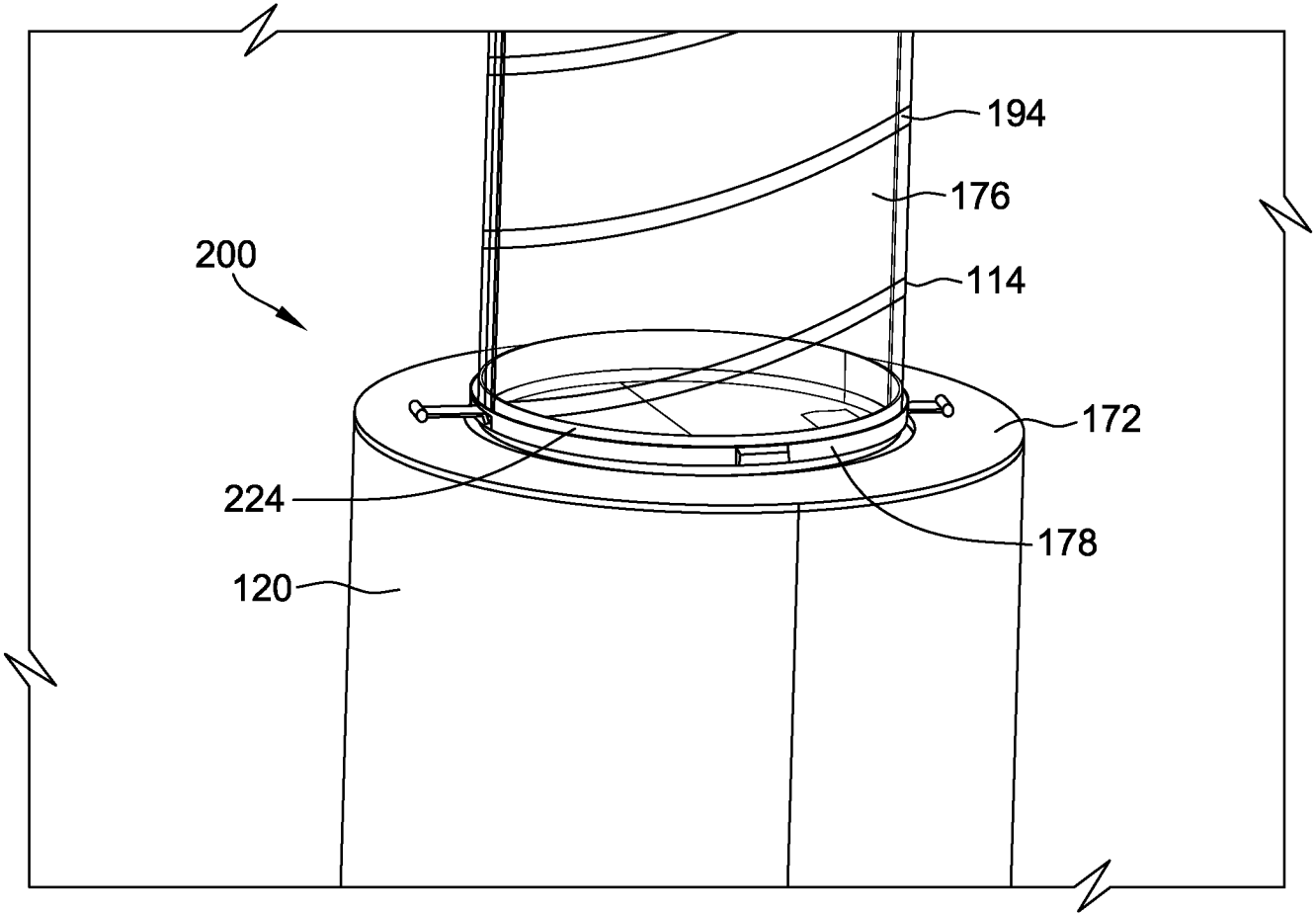
FIG. 4 is a perspective view of a chute and an associated container and an exemplary lid assembly coupled therebetween.

FIG. 4 is a perspective view of a lid assembly 200 coupled between first chute 114 and container 120. In the exemplary implementation, lid assembly 200 contains any vapors and/or airborne particles within container 120 and prevents such vapor and/or airborne particles from traveling up chute 114. In the exemplary implementation, biasing portion 176 of first chute 114 includes a flexible coil 194 that enables biasing portion 176 to stretch and compress in length. In operation, when lid 172 is coupled to container 120 in a snap fit relationship, coil 194 is compressed from a resting length to a shorter compressed length such that coil 194 biases lid 172 downward onto container 120. As such, biasing potion 176 applies a positive pressure to lid 172 that maintains engagement between lid 172 and container 120. A technician may easily break the biased engagement and lift lid 172 from container 120 when container 120 is to be emptied. When lid 172 and container 120 are decoupled, lid 172 then remains coupled to biasing portion 176 as biasing portion 176 extends into its resting length until the technician again compresses coil 194 in biasing portion 176 to couple lid 172 to container 120.

Figure 5:
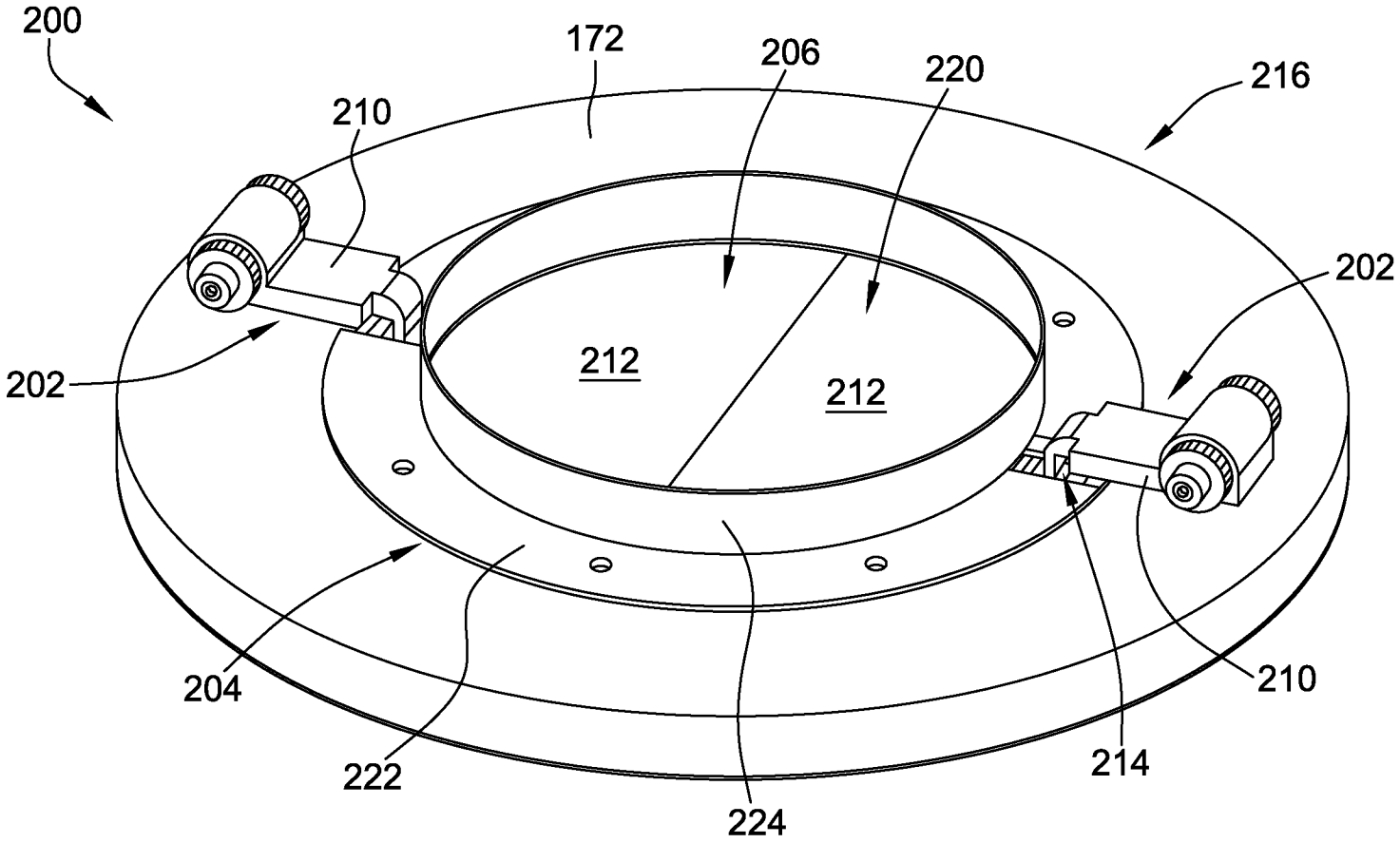
FIG. 5 is a top perspective view of the lid assembly in a closed position.
Figure 6:
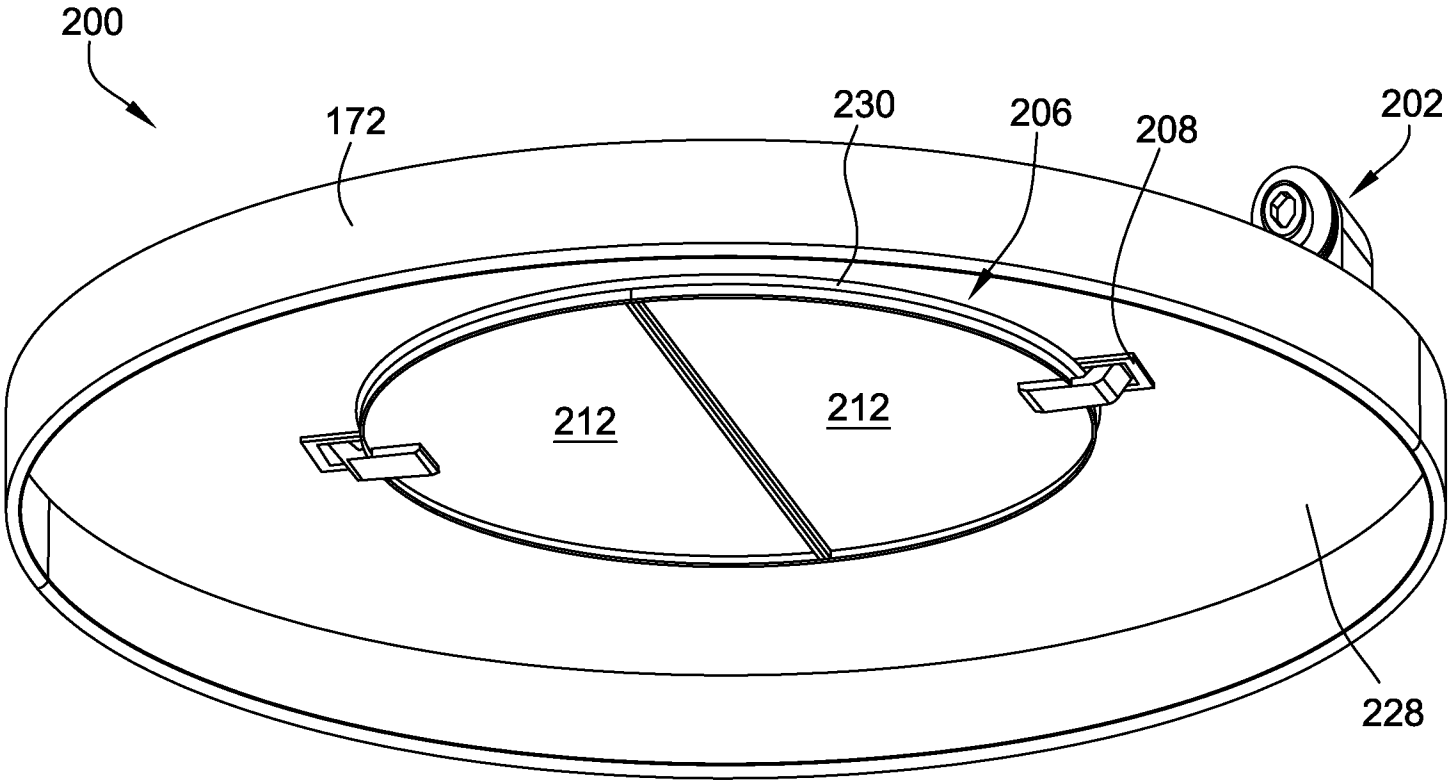
FIG. 6 is a bottom perspective view of the lid assembly in a closed position.
Figure 7:
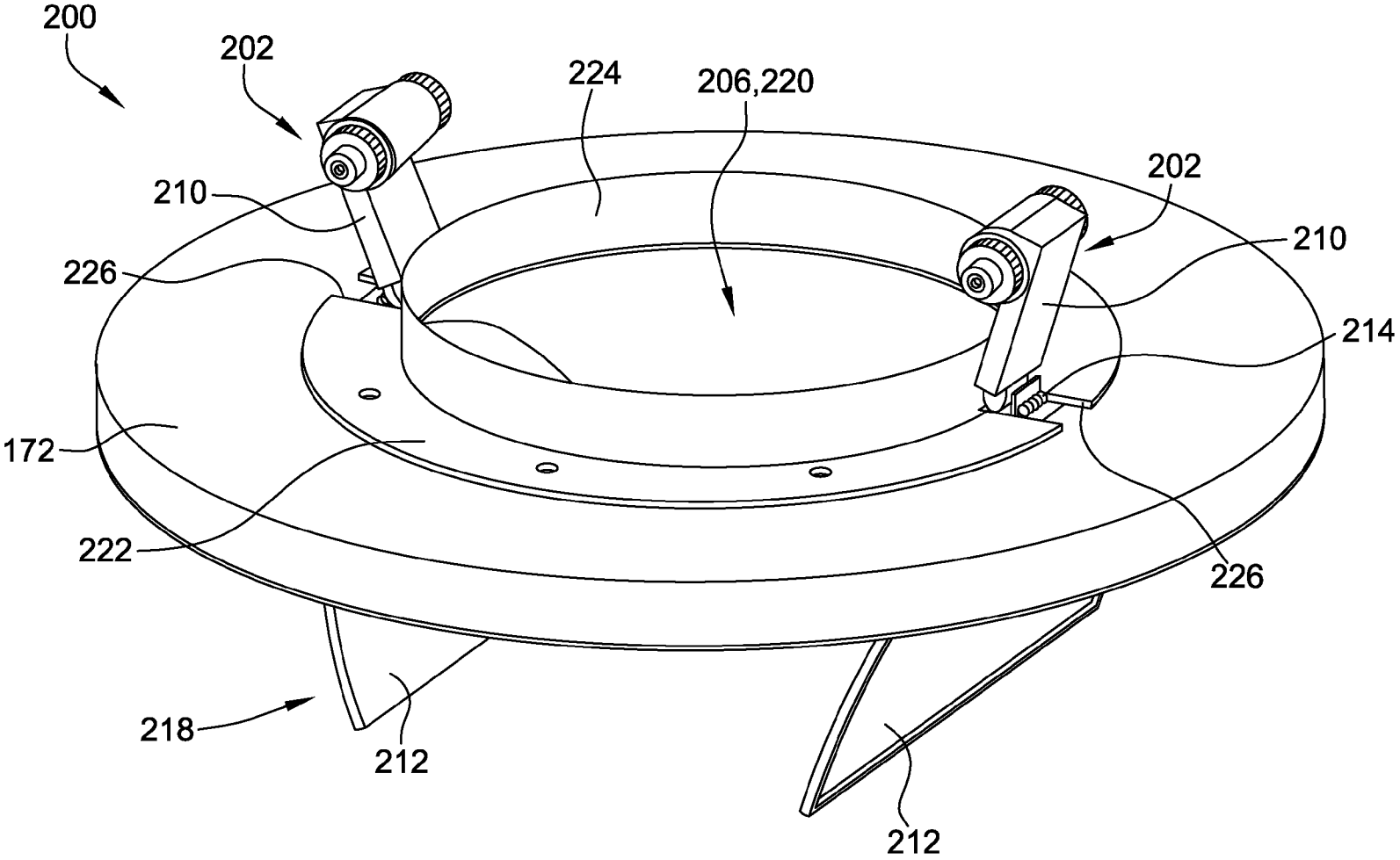
FIG. 7 is a top perspective view of the lid assembly in an open position.
Figure 8:
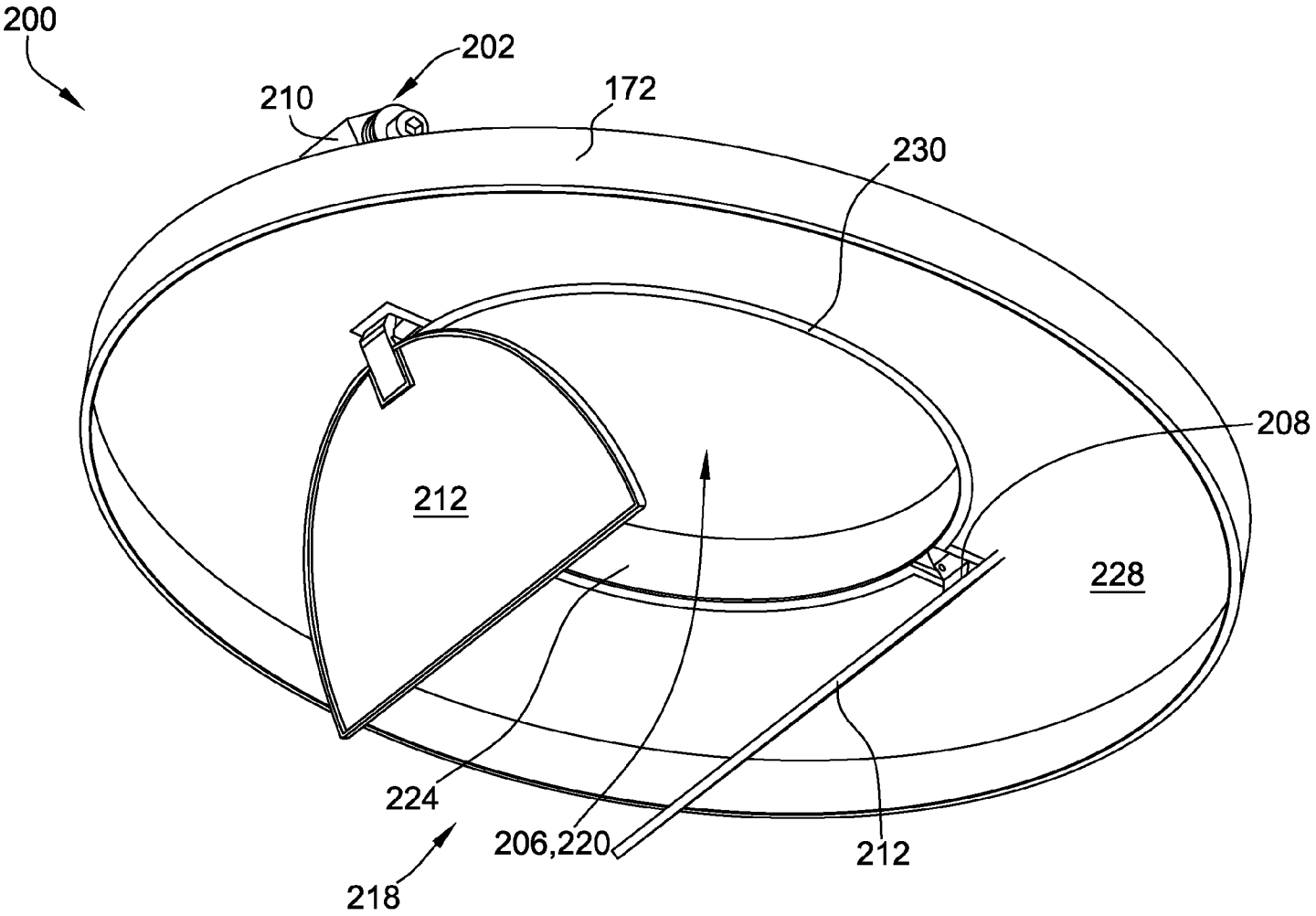
FIG. 8 is a bottom perspective view of the lid assembly in an open position.
Figure 9:
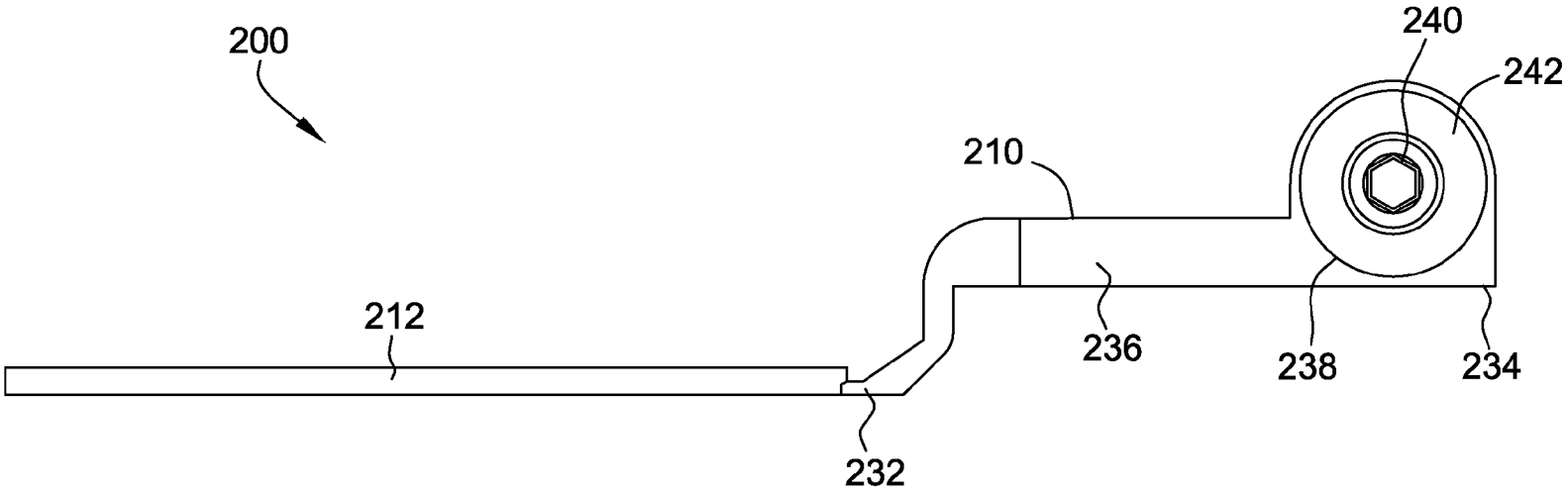
FIG. 9 is a side view of an exemplary flap assembly that may be used with the lid assembly shown in FIGS. 5-8.
Figure 10:
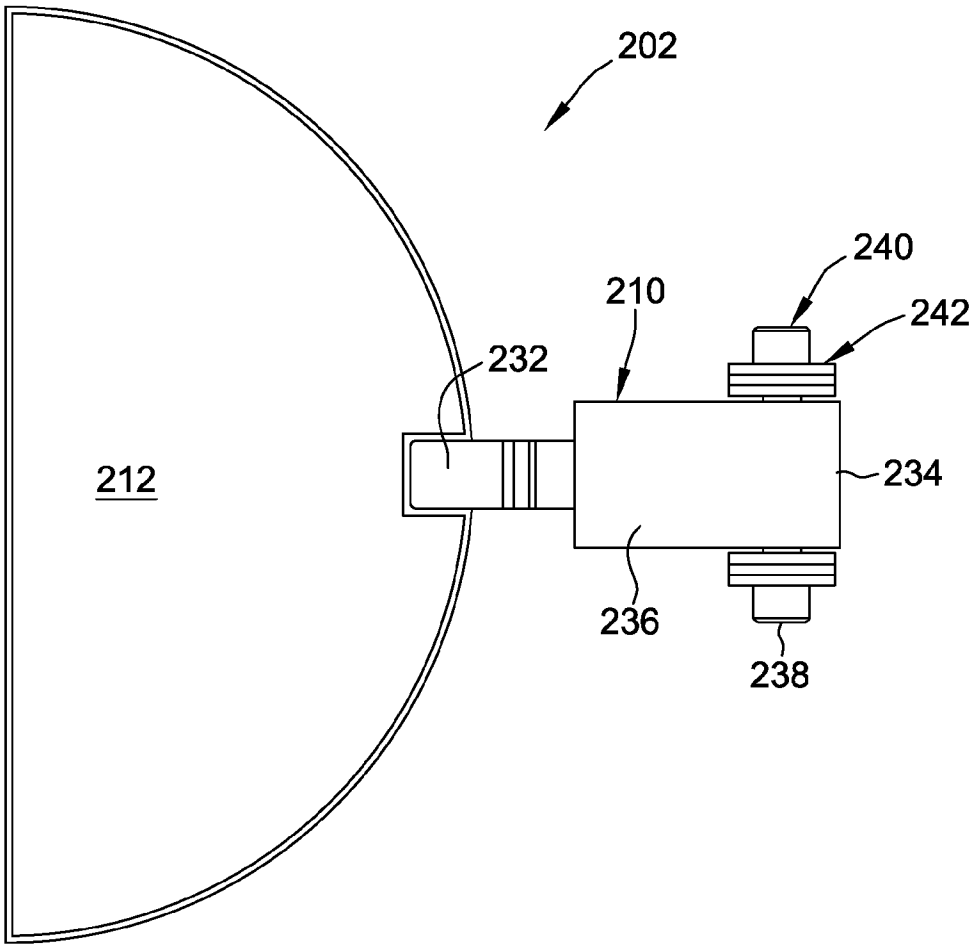
FIG. 10 is a top view of the flap assembly shown in FIG. 9.

FIG. 5 is a top perspective view of lid assembly 200 in a closed position, and FIG. 6 is a bottom perspective view of lid assembly 200 in a closed position. FIG. 7 is a top perspective view of lid assembly 200 in an open position, and FIG. 8 is a bottom perspective view of lid assembly 200 in an open position. FIG. 9 is a side view of an exemplary flap assembly 202 that may be used with lid assembly 200, and FIG. 10 is a top view of flap assembly 202.

In the exemplary implementation, lid assembly 200 includes lid 172, a pair of flap assemblies 202, and a coupling ring 204. As described above, lid 172 is removably coupled to container 120. Furthermore, lid 172 defines an opening 206 through which waste is able to pass from first chute 114 into container 120. Lid 172 also includes a pair of lid notches 208 formed opposite each other proximate opening 206. In the exemplary embodiment, a flap assembly 202 is coupled to lid 172 at a corresponding lid notch 208. More specifically, each flap assembly 202 includes a counterbalance mechanism 210 pivotally coupled to lid 172 at lid notch 208 and a flap portion 212 coupled to counterbalance mechanism 210. In the exemplary embodiment, counterbalance mechanism 210 is pivotally coupled to lip 172 using a hinge 214. Alternatively, counterbalance mechanism 210 is pivotally coupled to lip 172 by any means that facilitates operation of lid assembly 200 as described herein. Furthermore, lid assembly 200 includes a pair of flap assemblies 202 coupled opposite each other about opening 206 to enable each flap assembly 202 to pivot about its respective hinge 214 to selectively open and close opening 206. As described in further detail below, each flap assembly 202 is movable between a closed position 216 and an open position 218 to selectively obstruct opening 206. When flap portions 212 are closed, vapors or airborne particles in the waste within container 120 are substantially prevented from traveling up first chute 114.

In the exemplary implementation, coupling ring 204 is coupled to lid 172 and defines a second opening 220 that is substantially similar in size and concentric with opening 206. Similarly to opening 206, second opening 220 enables waste to pass from chute 114, through openings 206 and 220, and into container 120. Coupling ring 204 also includes a flange 222 coupled to lid 172 and a collar 224 extending upward from flange 222. Referring back to FIG. 4, in the exemplary implementation, collar 224 is coupled to a bottom end of biasing portion 176 with a clamp 178, and flange 222 is coupled to lid 172 with plurality of fasteners (not shown). Alternatively, collar 224 is coupled to biasing portion 176 and flange 222 to lid 172 in any manner that facilitates operation of lid assembly 200 as described herein. Ring flange 222 includes a pair of ring notches 226 formed opposite each other proximate openings 206 and 220. In the exemplary implementation, each ring notch 226 is aligned with and at least partially overlaps a corresponding lid notch 208 such that flap assembly 202 is coupled to lid 172 proximate notches 208 and 226, and, more specifically, within the space formed by notches 208 and 226.

Lid 172 also includes a bottom surface 228 having a sealing strip 230 coupled thereto. Sealing strip 230 forms a barrier between lid 172 and flap portion 212 of flap assembly 202 to prevent migration of vapors through openings 206 and 220 when flap assembly is in closed position 216.

In the exemplary implementation, counterbalance mechanism 210 includes a first end 232, a second end 234, and a body 236 extending therebetween. First end 232 is coupled to flap portion 212. In one implementation, first end 232 is welded to flap portion 212. Alternatively, first end 232 is coupled to flap portion 212 by any means that facilitates operation of flap assembly 202 as described herein. Body 234 is coupled to lid 172 at lid notch 208 via hinge 214, as described above. Second end 236 includes a counterbalance weight 238 coupled thereto that automatically moves flap assembly 202 from open position 218 to closed position 216. Furthermore, counterbalance weight 238 is adjustable such that a technician can modify counterbalance weight 238 to move flap assembly 202 at a desired rate. More specifically, counterbalance weight 238 includes a weight support 240 and a plurality of removable weights 242 that enable a technician to tune the number of weights 242 on support 240 such that flap assembly 202 automatically returns to the closed position 216 after waste had fallen through openings 206 and 220.

In operation, when a technician deposits waste into chute end 134 (shown in FIG. 2) at waste disposal station 102 (shown in FIG. 2), the waste falls down chute 114 and passes gate assembly 180 when gate 186 (both shown in FIG. 4) is in the open position. The waste then impinges on flap portions 212, which causes flap portions 212 to pivot about hinges 214 and move from the closed position 216 to the open position 218 to allow the waste to travel through openings 206 and 220 and be deposited into container 120. Advantageously, flap portions 212 are formed from a hard material, such as but not limited to stainless steel, such that flap portions 212 are able to withstand repeated impingements of waste. After the waste falls through openings 206 and 220, counterbalance mechanism 210, and more specifically counterbalance weight 238, causes flap portions 212 to return to the closed position 216. As described above, in the closed position 216, flap portions 212 contact sealing strip 230 on bottom surface 228 of lid 172 and form a seal to prevent vapors or airborne particles in the waste from traveling up chute 114. Furthermore, since counterbalance mechanism 210 is outside container 120, counterbalance mechanism 210, and more specifically second end 234 of counterbalance mechanism 210, is manually operable by a technician without requiring removal of lid 172 from container 120. As such, in the event that the waste is not heavy enough to trigger movement of flap assembly 202, or waste within container 120 prevents closure of flap assembly 202, a technician can manually operate flap assembly 202 using counterbalance mechanism 210 to resolve the issue.

As described above, each of chutes 116 and 118 includes a gate assembly and a lid assembly similar to assemblies 180 and 200 as described with respect to chute 114. Alternatively, chutes 114, 116, and 118 have any combination of assemblies 180 and 200 that enables waste management system 100 to operate as described herein.

The embodiments described herein facilitate depositing various types of waste into a respective chute on a platform and collecting the waste in containers located at ground level. A technician determines whether they have FOD waste, corrosive waste, or flammable waste and deposits the waste into the appropriate chute at a waste disposal station on the platform. The waste then travels through the chute and into a corresponding container located at ground level. When the container is full, another technician slides the gate inward to block the chute and removes the lid from the container. The lid remains coupled to the biasing portion of the chute while the technician empties the container. Once the container is emptied, the technician at least partially compresses the biasing portion of the chute to lift the lid above the container and then couples the lid to the container. The coil within the biasing portion causes the lid to apply a downward force onto the container to maintain a tight engagement.

As described herein, the waste management system allows technicians to deposit waste into an appropriate chute from a working platform such that the waste collects in containers at ground level. Therefore, technicians responsible for emptying the container are no longer required to climb a set of stairs onto the platform to empty the containers. Storing the containers at ground level provides cost savings in that technicians do not have to climb stairs 75-100 times per day as with at least some known waste management systems. Furthermore, any potential safety risks from the technicians carrying containers or bags of waste down from the platform are mitigated. Additionally, storing the containers at ground level and providing an over-the-rail waste disposal station provides for additional work space on the platforms for the technicians to perform their duties without the risk of tripping on one of the containers.

Furthermore, the embodiments described herein illustrate a lid assembly that uses a counterbalance weight to automatically return a flap assembly to a closed position once waste has passed therethrough. The lid assembly includes a lid coupled to a container and defining an opening therethrough. A flap assembly is coupled to opposing sides of the opening and includes a counterbalance mechanism pivotally coupled to the lid and a flap portion coupled to the counterbalance mechanism that at least partially covers the lid opening. As described above, when waste impinges on the flap portions, the flap assembly moves from the closed position to the open position to enable the waste to fall into the container. An adjustable counterbalance weight on the counterbalance mechanism then causes the flap assembly to pivot and return to the closed position. In the closed position, the flap portions form a seal with a sealing strip on the underside of the lid to prevent the escape of vapors or airborne waste form the container. The use of a counterbalance weight to return the flap assembly to the closed position takes advantage of gravity to move the flap assembly instead of using a positive biasing mechanism, such as a mechanism spring, that may have decreased performance over time. As such, the lid assembly described herein is a cost and labor efficient system to maintain the performance desired to prevent vapors from escaping the container and traveling back up the chute.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lid assembly for use with a waste management system, said lid assembly comprising:

a lid configured to couple to a container, said lid comprising an opening defined therethrough and at least one lid notch formed proximate said opening; and at least one flap assembly comprising:

a counterbalance mechanism pivotally coupled to said lid at said lid notch, wherein said counterbalance mechanism is positioned outside of the lid; and a flap portion coupled to said counterbalance mechanism, wherein said flap assembly is moveable between a closed position and an open position to selectively obstruct said opening.

2. The lid assembly in accordance with claim 1, wherein said counterbalance mechanism is configured to automatically move said at least one flap assembly from the open position to the closed position.

3. The lid assembly in accordance with claim 1, wherein said counterbalance mechanism comprises a first end coupled to said flap portion, a second end, and a body extending therebetween, said body coupled to said lid.

4. The lid assembly in accordance with claim 3, wherein said second end comprises a counterbalance weight configured to automatically move said flap assembly from the open position to the closed position.

5. The lid assembly in accordance with claim 4, wherein said counterbalance weight is adjustable to move said flap assembly at a desired rate.

6. The lid assembly in accordance with claim 3, wherein said second end is manually operable by a technician.

7. A waste management system comprising:

a chute configured to channel waste therethrough;

a container configured to collect the waste channeled through said chute; and a lid assembly coupled between said chute and said container, said lid assembly comprising:

a lid coupled to said container and comprising an opening defined therethrough; and at least one flap assembly comprising a counterbalance mechanism pivotally coupled to said lid and a flap portion coupled to said counterbalance mechanism, wherein said flap assembly is moveable between a closed position and an open position to selectively obstruct said opening.

8. The waste management system in accordance with claim 7, wherein said counterbalance mechanism is configured to automatically move from the closed position to the open position.

9. The waste management system in accordance with claim 7, wherein said lid comprises a bottom surface and a sealing strip coupled to said bottom surface, wherein said sealing strip forms a barrier between said lid and said flap portion to prevent migration of vapors through said opening.

10. The waste management system in accordance with claim 7, wherein said counterbalance mechanism comprises a first end coupled to said flap portion, a second end, and a body extending therebetween, said body coupled to said lid.

11. The waste management system in accordance with claim 10, wherein said second end comprises a counterbalance weight configured to automatically move said flap assembly from the closed position to the open position, wherein said counterbalance weight is adjustable to move said flap assembly at a desired rate.

12. The waste management system in accordance with claim 7, further comprising a coupling ring coupled to said lid and defining a second opening therethrough, wherein said coupling ring comprises a flange coupled to said lid and a collar extending from said flange.

13. A method of assembling a lid assembly for use with a waste management system, said method comprising:

defining an opening in a lid;

pivotally coupling a body of at least one counterbalance mechanism to the lid proximate the opening;

coupling at least one flap portion to a first end of the body; and coupling a counterbalance weight to an opposing second end of the body, wherein the at least one counterbalance mechanism and the at least one flap portion are moveable between a closed position and an open position to selectively obstruct the opening, wherein the counterbalance mechanism is positioned above a first side of the lid and the flap portion is positioned below an opposing second side of the lid.

14. The method according to claim 13, further comprising coupling a sealing strip to a bottom surface of the lid such that the sealing strip forms a barrier between the lid and the at least one flap portion to prevent migration of vapors through the opening when the at least one flap portion is in the closed position.

15. The method according to claim 13, wherein coupling a counterbalance weight to an opposing second end of the body comprises coupling an adjustable counterbalance weight to the second end such that the at least one flap portion automatically moves from the open position to the closed position at a desired rate.

16. The method according to claim 13, further comprising coupling a coupling ring to the lid, wherein said coupling ring comprises a flange coupled to the lid and a collar extending from the flange.

17. A lid assembly for use with a waste management system, said lid assembly comprising:

a lid configured to couple to a container, said lid comprising an opening defined therethrough, a bottom surface, and a sealing strip coupled to said bottom surface; and at least one flap assembly comprising:

a counterbalance mechanism pivotally coupled to said lid, wherein said counterbalance mechanism is positioned outside of the lid; and a flap portion coupled to said counterbalance mechanism, wherein said flap assembly is moveable between a closed position and an open position to selectively obstruct said opening, wherein said sealing strip forms a barrier between said lid and said flap portion to prevent migration of vapors through said opening.

18. A lid assembly for use with a waste management system, said lid assembly comprising:

a lid configured to couple to a container, said lid comprising an opening defined therethrough;

a coupling ring coupled to said lid and defining a second opening therethrough, wherein said coupling ring comprises a flange coupled to said lid and a collar extending from said flange; and at least one flap assembly comprising:

a counterbalance mechanism pivotally coupled to said lid, wherein said counterbalance mechanism is positioned outside of the lid; and a flap portion coupled to said counterbalance mechanism, wherein said flap assembly is moveable between a closed position and an open position to selectively obstruct said opening.

19. The lid assembly in accordance with claim 18, wherein said lid comprises at least one lid notch and said coupling ring comprises at least one ring notch that at least partially overlaps said at least one lid notch, wherein said flap assembly is coupled to said lid proximate said at least one lid notch and said at least one ring notch.

* * * * *